US006174600B1

(12) United States Patent
Brown et al.

(10) Patent No.: US 6,174,600 B1
(45) Date of Patent: Jan. 16, 2001

(54) BRISTLES EMPLOYING PARTICULATES AND BRUSHES INCLUDING SAME

(75) Inventors: James M. Brown, East Middlebury; Tom R. Huskey, Middlebury, both of VT (US); David Prawdzik, Andover, MA (US); Joseph M. Collins, Middlebury, VT (US)

(73) Assignee: Speciality Filaments, Inc., Burlington, VT (US)

( * ) Notice: Under 35 U.S.C. 154(b), the term of this patent shall be extended for 0 days.

(21) Appl. No.: 09/186,833

(22) Filed: Nov. 5, 1998

Related U.S. Application Data

(60) Provisional application No. 60/064,894, filed on Nov. 7, 1997, now abandoned.

(51) Int. Cl.[7] ..... D02G 3/00; A46B 11/00

(52) U.S. Cl. ..... 428/372; 428/364; 428/398; 428/400; 15/159.1

(58) Field of Search ..... 428/364, 372, 428/398, 400; 15/159.1, 207.2, DIG. 6

(56) References Cited

U.S. PATENT DOCUMENTS 5,679,067 * 10/1997 Johnson et al. ..... 451/527

* cited by examiner

*Primary Examiner*—William Krynski
*Assistant Examiner*—J. M. Gray
(74) *Attorney, Agent, or Firm*—Caesar, Rivise, Bernstein, Cohen & Pokotilow, LTD

(57) ABSTRACT

A synthetic bristle including a substantially continuous phase of polymer with spaced-apart microparticles in the interior thereof, at least some of said microparticles being close to the surface thereof for creating rough and irregular surface regions. The bristle can include a blowing agent in it, in addition to the microparticles, and the microparticles preferably are hollow glass beads. Brushes employing at least 5% by weight of the bristles of this invention also constitute a part of this invention, with the preferred brushes being applicator brushes, such as paintbrushes.

29 Claims, 3 Drawing Sheets

BRISTLES EMPLOYING PARTICULATES AND BRUSHES INCLUDING SAME

RELATED APPLICATIONS

This is a utility application based upon provisional application serial No. 60/064894, filed on Nov. 7, 1997, abandoned, entitled BRISTLES EMPLOYING PARTICULATES AND BRUSH INCLUDING SAME. Applicant hereby claims the benefit of the filing date of the '894 provisional application for this utility application.

FIELD OF THE INVENTION

This invention relates to synthetic bristles having a number of the advantages of natural (e.g., hog's hair) bristles but without certain attendant disadvantages, such as uncontrollable or irregular cross-section, high cost and inconsistent availability. This invention also relates to brushes employing such bristles.

The bristles of this invention employ particulates in a manner to provide an irregular and/or roughened surface, and are particularly well-suited for use in paintbrushes. However, the bristles are believed to have desirable attributes for use in other applicator brushes, e.g., scrub brushes, with or without the use of cleaning/scrubbing compounds or ingredients, and the like. In addition, the bristles of this invention also are believed to have desirable attributes for other brushes, such as beater brushes in vacuum cleaners.

BACKGROUND OF THE INVENTION

Microcellular synthetic bristles formed by the use of a blowing agent to form closed cells in the interior of the bristles and ruptured cells at the surface are known in the prior art, as exemplified by the teachings in U.S. Pat. No. 4,937,141 (Burns); U.S. Pat. No. 5,022,112 (Burns); U.S. Pat. No. 5,032,456 (O'Brien et al.) and U.S. Pat. No. 5,151,229 (Burns). The subject matter of all of the aforementioned patents is fully incorporated herein by reference.

Although the use of blowing agents in the manufacture of bristles has resulted in the formation of irregularities (i.e., provided by open cells) on the surface of the bristles, thereby simulating the desirable surface characteristics of natural bristles, the substantial randomness of such irregularities has made it difficult to provide a desired percentage of the bristles with a desired degree of such surface irregularity. Thus, a number of the formed bristles have surfaces that are so smooth, or have such extremely limited surface irregularities, that the desired benefits of a rough, irregular surface are not achieved.

Moreover, bristles formed only with blowing agents have not had the desired bend recovery characteristics for applications in which the bristles are subjected to high bending forces, and therefore crack, crimp, or often break, or often do not recover do to lack of stiffness.

In addition, although employing a blowing agent to form bristles does result in a lower bulk density than forming the bristles without such a blowing agent, a need still exists for bristles of even lower bulk density, but without detracting from other desirable characteristics of the bristles.

In addition, bristles formed solely with a blowing agent, or without a blowing agent, often are difficult to handle in brush forming equipment, due to the fact that the individual filaments do not easily flow relative to each other and therefore tend to move in clumps to the picker unit to interfere with the precise picking and placement of the bristles in the brushes.

SUMMARY OF THE INVENTION

A synthetic bristle in accordance with this invention includes a substantially continuous phase of polymer with spaced-apart microparticles in the interior thereof, at least some of said microparticles being close to the surface thereof for creating rough and irregular surface regions; one or more of which may be created by a crater in the outer surface.

In the preferred embodiment of this invention the microparticles include substantially spherical particles, e.g., hollow glass spheres, solid glass beads, hollow ceramic spheres and solid ceramic spheres; with the most preferred form of the invention including hollow glass spheres.

Preferably the continuous phase of polymer in the synthetic bristle defines closed cells surrounded by polymer and being interspersed with the microparticles in the interior of the bristle, with the closed cells being provided by a blowing agent.

In a preferred embodiment of this invention the rough and irregular surface regions include a surface of at least one of said microparticles and/or a raised polymer surface overlying at least one of said microparticles.

In a preferred embodiment of this invention the rough and irregular outer surface includes multiple craters, at least one of said craters being formed as an open cell by a blowing agent and at least one of said craters being formed by an escaped microparticle.

A brush in accordance with a preferred embodiment of this invention includes a handle and a bundle of bristles, at least 5% of said bristles being synthetic bristles including a substantially continuous phase of polymer with spaced-apart microparticles in the interior thereof, at least some of said microparticles being close to the surface thereof for creating rough and irregular surface regions.

Most preferably the continuous phase of polymer in bristles in the brush defines closed cells surrounded by polymer and being interspersed with the microparticles in the interior of said bristle, said closed cells being provided by a blowing agent.

BRIEF DESCRIPTION OF THE DRAWINGS

Other objects and may of the advantages of this invention will be readily appreciated as the same becomes better understood by reference to the following detailed description when considered in connection with the accompanying drawings wherein.

BEST MODE OF THE INVENTION

Figure 1:
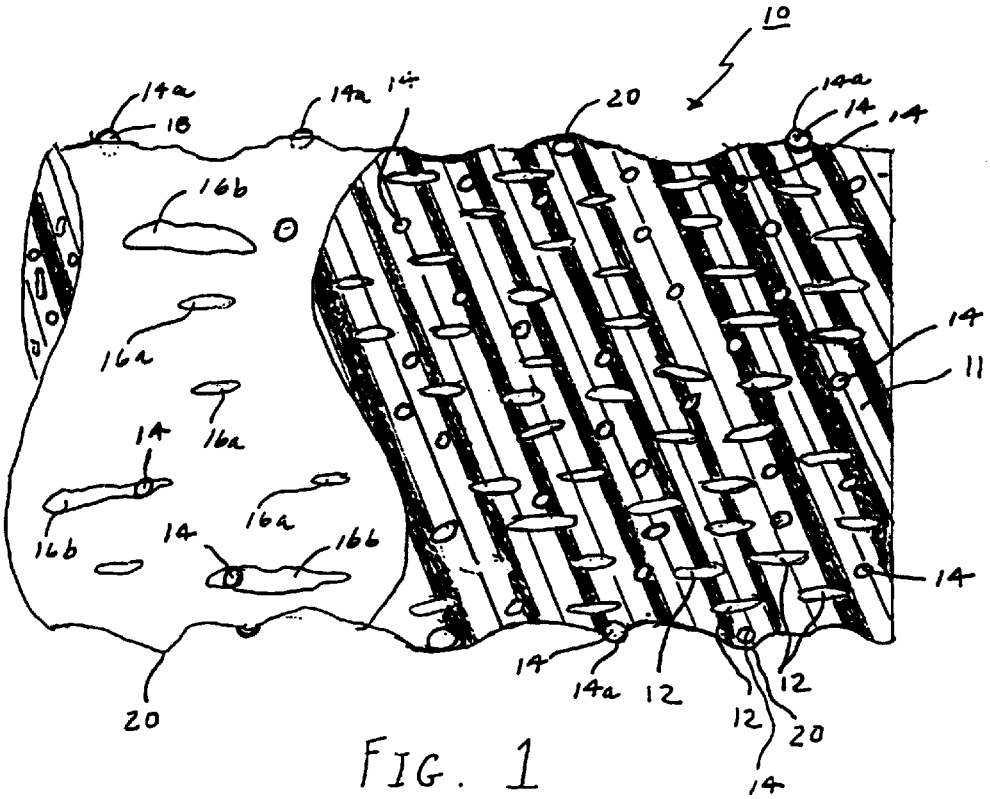
FIG. 1 is an enlarged (approx. 200–250X), idealized fragmentary side elevational view, with parts broken away, showing a bristle in accordance with this invention.

Synthetic bristles in accordance with this invention are composed of commonly employed thermoplastic materials selected from the group consisting of (a) a synthesized polymer, (b) a co-polymer, (c) an alloy, or mixture of synthetic polymers. Exemplary thermoplastic polymers include nylon, polyester, polyolefin, or blends thereof, e.g., a mixture of polyolefin and nylon (e.g., Amalon), or a mixture of polyester and nylon (e.g., Esterlon).

In a preferred embodiment of this invention, the bristles are made with the following formulation: 37% by weight PBT (polybutyleneterephthalate), 54.2% by weight PET (polyethyleneterephthalate), 3% by weight polyethylene, 3% by weight color concentrate, 0.8% blowing agent and 2% microparticles. Although the above formulation is slightly different from the formulation reported in the aforementioned '894 provisional application, it should be noted that the formulation reported in the '894 application, which is hereby incorporated by reference herein, is useable in this invention, although it is less preferred than the formulation set forth above.

Most preferably the microparticles are hollow glass spheres sold by The 3M Company under the name Scotchlite—Code S60-1000, which has the general consistency of flour, and the blowing agent is CF-40 sold by Henley Chemical Company. It should be understood that the composition of the bristles may be varied, and that the above specific example is a formulation that has resulted in the formation of a desired bristle within the scope of this invention. For example, although hollow glass spheres have been employed successfully in this invention, it is believed that similar results can be achieved with hollow ceramic spheres, as will as with solid glass or ceramic beads. Most preferably, the particles are spherical in configuration, but other shapes having a three-dimensional configuration in all orientations (not flat, planar particles) are believed to be usable in the present invention.

Although the composition/formulation of the bristles can be varied, the quantity of blowing agent needs to be controlled. In particular, the quantity of blowing agent should not exceed 2% by weight based upon the total composition and most preferably should be over 0.3% by weight of the total composition.

The bristles of this invention employing both a blowing agent and microparticles, are characterized by having closed cells interspersed with the spheres in the interior, and a combination of different surface characteristics that provide a rough an irregular surface comparable to that of natural bristles, such as hog's hair bristles, all as will be described in greater detail hereinafter.

Moreover, bristles of this invention formed with microparticles in them have been determined to have much better bend recovery properties than prior art bristles formed without such microparticles. Whereas prior art bristles employing only a blowing agent tend break, crack or crimp when excessively bent or deformed in use, the bristles of this invention tend to maintain their structural integrity when subjected to such bending or deformation, such as often occurs in brush applications, e.g., paintbrush applications, etc.

In addition, the bristles formed with microparticles in accordance with this invention have a higher abrasion resistance than prior art bristles, which makes the bristles of this invention extremely well-suited for applications in which they are subjected to high abrasive forces, e.g., beater brushes in vacuum cleaners, etc.

Moreover, the use of hollow spheres as the microparticles provides a reduction in bulk density, as compared to similar bristles made without such spheres. Moreover, the inclusion of a blowing agent with the hollow spheres further reduces the bulk density. Since bristles generally are sold by the pound, a reduction in bulk density results in a higher yield to the customer.

Moreover, the inclusion of microparticles in the bristles of this invention has been determined to provided an increased roughness to the surface, which enhances the amount of paint that is picked up by a paintbrush employing such bristles, as compared to a paintbrush employing bristles made solely with a blowing agent. This increased pick-up results in significantly improved paint-out achieved with a brush employing bristles with microparticles within the scope of this invention.

Referring to FIG. 1, an enlarged (approx. 200–250X), idealized fragmentary side elevational view of a solid bristle 10 in accordance with this invention is shown, with parts broken away to show details of construction. As noted above, the interior of the bristle includes a substantially continuous phase of polymer 11 with spaced-apart closed cell 12 (created by the blowing agent) interspersed with microspheres 14. The bristle 10 includes a number of different surface irregularities.

These surface irregularities provide a desired rough, irregular surface that enhances the ability of the bristles of this invention to retain paint and/or other materials intended to be applied with brushes employing such bristles. In addition, this rough, irregular surface is believed to be well suited for use in scrub brushes that are used either with or without a cleaning composition or agent.

Still referring to FIG. 1, the surface roughness and irregularities in the bristle 10 include craters 16*a* and 16*b*, exposed surfaces 14*a* of hollow glass spheres 14, and raised polymer surfaces 20.

The craters 16*a* are provided by ruptured cells resulting from the use of the blowing agent, and the ruptured cells 16*b* are provided by relatively loosely retained spherical particles 14 sliding along and scratching the bristle surface as these particles engage interior walls of the extrusion die or spinneret during the extrusion process. As can be seen in FIG. 1, these loosely retained spherical particles 14 actually can remain in the crater they form or escape from the bristle surface. In most of the bristles of this invention craters will be created on the surface both by the rupturing of cells formed with the blowing agent and by the scratching of the surface by escaping, or retained, loosely held spherical particles 14. However, it is within the scope of this invention to achieve the formation of craters by either of the above mechanisms, without the other.

Frequently some of the spherical particles 14 adjacent the surface actually penetrate through the polymer surface to provide exposed surfaces 14*a* of those particles 14. These exposed surfaces 14*a* impart surface roughness/irregularities to the bristles. However, in some cases the particles 14 adjacent the surface actually "bulge" the overlying polymer to create raised polymer surfaces 20 that impart surface roughness/irregularities to the bristles.

Figure 2:
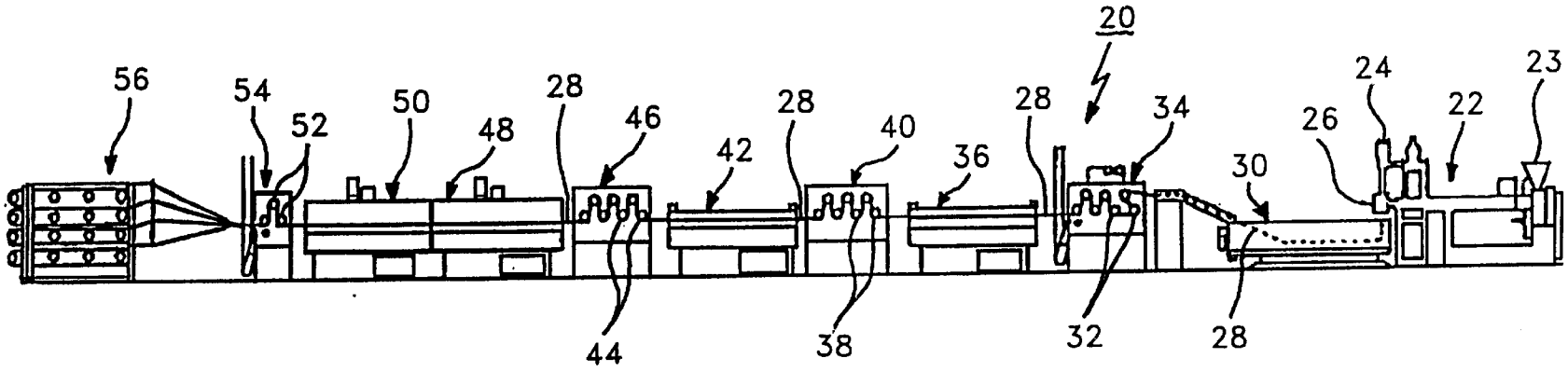
FIG. 2 is a schematic side elevational view of an exemplary processing line usable for forming bristles in accordance with this invention.

Referring to FIG. 2, a schematic representation of an exemplary process line usable to form bristles 10 in accordance with this invention is shown at 20. The upstream extruder 22 includes three (3) separate hoppers; only one being illustrated at 23. The three hoppers are disposed circumferentially about the throat of the extruder at the upstream end thereof, and each hopper empties into its own underlying feed screw. These feed screws direct the contents from the overlying hoppers into a common, upstream throat of the extruder barrel, for blending, melting and feeding in a downstream direction to a melt pump 24. The melt pump evens out the internal pressure and then directs the melt through a spinneret 26 at the downstream end of the extruder to form continuous filaments 28.

In the preferred embodiment of the invention a blend of the three polymers is first formed off line. That is, the polyethyleneterephthalate (54.2% by weight), polybutyleneterephthalate (37% by weight) and polyethylene (3% by weight) are first blended together and then tumbled with the glass spheres (2% by weight). To enhance the adhesion of the spheres to the polymer blend a vegetable oil is employed. However, it is envisioned that such an additive may not be required in a commercial line. The tumbled blend of polymers and glass spheres is directed into one of the three hoppers at the upstream end of the extruder 22. The blowing agent (1.65% by weight) is introduced into the second hopper and a desired color concentrate (2% by weight) is introduced into the third hopper. It should be understood that the coloring of the bristles is optional, and the third hopper can be eliminated, or at least not used, when the filaments to be formed are not intended, or required, to be colored.

The contents of the hoppers are then directed to a common throat of the extruder 22, from where they are directed by a screw feeder through several temperature-controlled extruder zones in the extruder barrel to melt the mix in a controlled manner. As noted in O'Brien et al. U.S. Pat. No. 5,032,456, the subject matter of which already has been incorporated by reference herein, the temperature conditions within the various extruder zones need to be closely controlled, with the beginning zones in the barrel being cooler than normally employed when extruding non-cellular bristles, i.e., bristles without the use of a blowing agent.

Still referring to FIG. 2, the extruded filaments 28 are then immediately directed into a water quench 30, which solidifies, or freezes, the filaments in the configuration existing at the time of quenching. Thus, it should be apparent that the desired activity of the blowing agent in both the internal core region and surface region of the filaments must be completed prior to quenching.

The quenched filaments are pulled through the water quench 30 by being directed through positively driven feed rolls 32 of a first roll stand 34, with all of the rolls 32 being driven at the same speed.

The filaments 28 are then directed through a first oven 36 in which the filaments are stretched, or oriented by the combination of the pulling action imposed upon the filaments by positively driven feed rolls 38 of a second roll stand 40 and a braking action imposed upon the rolls 32 of the first roll stand 34, with all of the rolls 38 being driven at the same speed but faster than the rolls 32.

The filaments 28 are then directed from the second roll stand 40 through a second oven 42 in which the filaments are further stretched, or oriented. This stretching or orienting operation is achieved by the combination of the pulling action imposed upon the filaments by positively driven feed rolls 44 of a third roll stand 46 and a braking action imposed upon the feed rolls 38 of the second roll stand 40, with all of the rolls 44 being driven at the same speed but faster than the rolls 38.

The number of stretching or orienting stages can be varied; however, one or two such stages are commonly employed when fabricating level bristles (i.e., bristles having a substantially uniform diameter or cross-sectional configuration along the entire length thereof).

The filaments 28, after the final orientation step, are then directed through a pair of heat-setting ovens 48 and 50 in which the filaments are relaxed by annealing (i.e., crystallization). The filaments are directed through and out of the ovens 48 and 50 by positively driven feed rolls 52 of a fourth roll stand 54. However, the rolls 52 of the fourth roll stand 54 are driven at substantially the same, or lower, speed as the rolls 44 of the third roll stand 46 to avoid stretching the filaments after they have been annealed.

After annealing the filaments are directed onto spools or wheels of a conventional wind-up stand 56. The spools or wheels are then directed to a further converting operation in which they are bundled into desired bristle lengths for inclusion into brushes.

Reference throughout this application to "bristles", unless specifically limited, includes both the continuous filaments from which the cut bristles are formed and the cut bristles formed from the continuous filaments. When the bristles are identified as being an integral part of a brush construction than the reference to "bristles" means only the bristles cut from the filaments.

The specific processing parameters, i.e., temperatures of the extrusion zones of the extruder, speeds of the rolls of the various roll stands, temperatures in the ovens employed in the various orientation stages and heat-setting stages, etc., will depend upon a number of factors, including, but not limited to, the specific polymer composition being employed, the specific quantity and type of blowing agent being employed and the bristle stiffness and surface properties desired. The selection of these processing parameters can be made easily by a person having ordinary skill in the art, without the exercise of undue experimentation or inventive activity.

Although the synthetic bristles in the most preferred embodiment of this invention employ both a blowing agent and microparticles to achieve the desired bristle characteristics, it is within the scope of broader aspects of this invention to provide synthetic bristles having microparticles, but without the use of a blowing agent. In this latter embodiment of the invention, the interior and surface regions of the bristles will not include cells and/or craters formed by a blowing agent.

Figure 3:
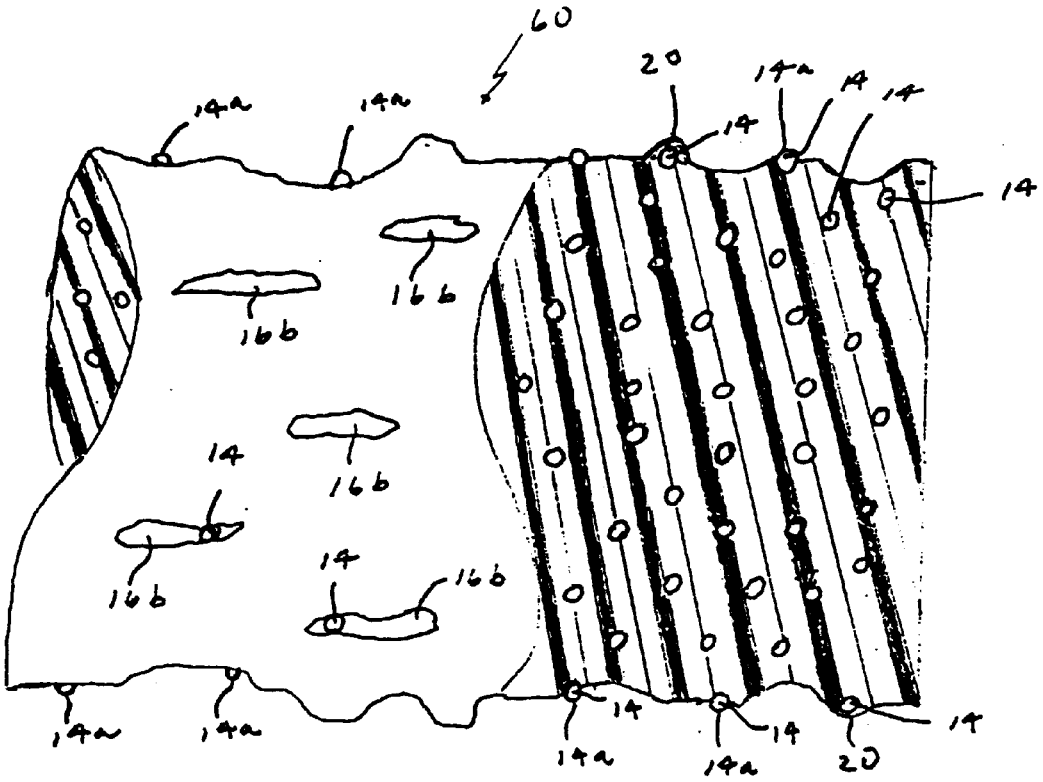
FIG. 3 is an enlarged (approx. 200–250X), idealized fragmentary side elevational view, with parts broken away, showing another embodiment of a bristle in accordance with this invention.

In this latter embodiment of the invention, as illustrated at 60 in FIG. 3, (which is an enlarged (approx. 200–250X), idealized, fragmentary, side elevational view partially in section) microparticles 14, preferably hollow spherical glass or ceramic beads, provide an internal, stiffening matrix, and also a roughened/irregular surface. As explained earlier in connection with the bristles 10 of the most preferred embodiment of this invention, the roughened/irregular surface will be provided by one or more of the following: (i) craters **16*b* created by loosely held particles 14 that scratch the bristle surface before escaping, (ii) by surfaces 14*a* of the microparticles 14 themselves, and also (iii) by raised polymer surfaces 20 overlying microparticles 14** at the bristle surface. The roughened outer surface provided by the microparticles is expected to result in enhanced paint-out as compared to the use of bristles with a blowing agent, but without microparticles.

In accordance with this invention, a preferred formulation of bristles 60 without a blowing agent is as follows: 37% by weight PBT (polybutyleneterephthalate), 56% by weight PET (polyethylene-terephthalate), 3% by weight polyethylene, 2% by weight color concentrate and 2% microparticles.

In accordance with both of the above embodiments of the invention, the bristles 10, 60 either can be level (i.e., substantially uniform diameter or other cross-sectional dimension along the length) or tapered (i.e., varying diameter or other cross-sectional dimension from one end to the other). Moreover, the bristles can be of any desired cross-sectional shape, can include raised ribs or spokes and can be solid or include one or more hollow passages extending the length thereof. However, even the solid bristles will have internal discontinuities provided by the microparticles and/or cellular voids created by a blowing agent.

When the bristles are employed in an applicator brush, such as a paintbrush, the distal ends can be flagged or tipped to enhance the uniformity of application. Most desirably, when the bristles of this invention are employed in paintbrushes they have a length of about 1.5 to 7 inches, a median diameter of about 5 to 14 mils (tapered or level), and a stiffness in the range of 1.8 to 7.5 lbs./in$^3$, as measured in a bundle by the pendulum deflection method at a binding angle of 50 degrees. Most preferably, the range of diameters in the tapered bristles of this invention is 7/4 mils to 18/10 mils, it being understood that the first figure of each pair is the diameter at the large or butt end and the second figure is the diameter at the small or tip end. It is this small or tip end that is exposed in the brushes of this invention, and if desired, either tipped or flagged.

Most preferably at least 5% by weight; more preferably at least 10% by weight and most preferably at least 15% by weight of the bristles employed in the brushes of this invention are the synthetic bristles of this invention. The remaining bristles can be other synthetic bristles, natural bristles (e.g., hog's hair), or combinations thereof. If desired, 100% of the bristles of this invention can be employed in the brushes of this invention.

It should be understood that the brushes of this invention can be of any well-known construction; have a variety of different handle configurations and bristle retaining members. In a conventional paint brush construction employing bristles of this invention a metal ferrule is attached to the downstream end of the handle and the proximal, or upstream, end of the bundle of bristles is secured within the ferrule in a conventional manner.

Without further elaboration, the foregoing will so fully illustrate my invention that others may, by applying current or future knowledge, readily adopt the same for use under various conditions of service.

What we claim as the invention is the following:

1. A synthetic bristle including a substantially continuous phase of polymer with spaced-apart microparticles in the interior of the bristle, at least some of said microparticles being close to the surface of the bristle for creating rough and irregular surface regions, said microparticles being hollow ceramic spheres.

2. A synthetic bristle including a substantially continuous phase of polymer with spaced-apart substantially spherical microparticles in the interior of the bristle, at least some of said substantially spherical microparticles being close to the surface of the bristle for creating rough and irregular surface regions, wherein said substantially spherical microparticles are solid ceramic beads.

3. A synthetic bristle including a substantially continuous phase of polymer with spaced-apart microparticles in the interior of the bristle, at least some of said microparticles being close to the surface of the bristle for creating rough and irregular surface regions, wherein said continuous phase of polymer defines closed cells surrounded by polymer and being interspersed with the microparticles in the interior of said bristle, said closed cells being provided by a blowing agent.

4. The synthetic bristle of claim 3, further including at least one crater in the outer surface of the bristle for providing a rough and irregular surface region.

5. The synthetic bristle of claim 4, wherein said at least one crater is formed as an open cell by the blowing agent.

6. The synthetic bristle of claim 3, including multiple craters in the outer surface thereof for providing a rough and irregular surface, at least one of said craters being formed as an open cell by the blowing agent and at least one of said craters being formed by an escaped microparticle.

7. The synthetic bristle of claim 3, wherein said rough and irregular surface regions include a surface of at least one of said microparticles.

8. The synthetic bristle of claim 3, wherein said rough and irregular surface regions include a raised polymer surface overlying at least one of said microparticles.

9. The synthetic bristle of claim 3, wherein said microparticles are substantially spherical particles.

10. The synthetic bristle of claim 9, further including at least one crater in the outer surface of the bristle for providing a rough and irregular surface region.

11. The synthetic bristle of claim 10, wherein said at least one crater is formed as an open cell by the blowing agent.

12. The synthetic bristle of claim 9, including multiple craters in the outer surface of the bristle for providing a rough and irregular surface, at least one of said craters being formed as an open cell by the blowing agent and at least one of said craters being formed by an escaped microparticle.

13. The synthetic bristle of claim 9, wherein said rough and irregular surface regions include a surface of at least one of said microparticles.

14. The synthetic bristle of claim 9, wherein said rough and irregular surface regions include a raised polymer surface overlying at least one of said microparticles.

15. An extruded, stretch-oriented synthetic bristle having the necessary stiffness, length and thickness to make the bristle well-suited for use in paint brushes, said bristle including a substantially continuous phase of polymer with spaced-apart microparticles in the interior of the bristle, at least some of said microparticles being close to the surface of the bristle for creating rough and irregular surface regions, further including multiple craters in the outer surface thereof for providing additional rough and irregular surface regions, said rough and irregular surface regions being effective in picking up paint when said bristle is employed in a paint brush.

16. The synthetic bristle of claim 15, wherein said microparticles are substantially spherical particles.

17. A brush having a handle and a bundle of bristles, at least 5% of said bristles being synthetic bristles including a substantially continuous phase of polymer with spaced-apart microparticles in the interior of the bristles, at least some of said microparticles being close to the surface of the bristles for creating rough and irregular surface regions, said continuous phase of polymer defining closed cells surrounded by polymer and being interspersed with the microparticles in the interior of said bristles, said closed cells being provided by a blowing agent.

18. The brush of claim 17, wherein the microparticles in said synthetic bristles include substantially spherical particles.

19. The brush of claim 17, wherein said microparticles are glass beads.

20. The brush of claim 17, wherein said rough and irregular surface regions include at least one irregular surface region in which a microparticle has escaped from the surface.

21. A paint brush having a handle and a bundle of paint bristles, at least 5% of said paint bristles being extruded, stretch-oriented synthetic bristles including a substantially continuous phase of polymer with spaced-apart microparticles in the interior of said bristles, at least some of said microparticles being close to the surface of the bristles for creating rough and irregular surface regions, said rough and irregular surface regions enhancing the amount of paint that is picked up by the paint bristles.

22. The paint brush of claim 21, at least 10% of said paint bristles being said synthetic bristles.

23. The paint brush of claim 21, at least 15% of said paint bristles being said synthetic bristles.

24. The paint brush of claim 21, 100% of said paint bristles being said synthetic bristles.

25. The paint brush of claim 21, wherein said continuous phase of polymer defines closed cells surrounded by polymer and being interspersed with the microparticles in the interior of said synthetic bristles, said closed cells being provided by a blowing agent.

26. The paint brush of claim 21, wherein said synthetic bristles have a length of about 1.5 to 7 inches and a median diameter of about 5 to 14 mils.

27. The paint brush of claim 21, wherein said synthetic bristles are tapered bristles being larger at a butt end attached to the handle than at a tip end remote from the end attached to the handle.

28. The paint brush of claim 27, wherein the tapered synthetic bristles have a diameter at the butt end in the range of 7 to 18 mils and a diameter at the tip end in the range of 4 to 10 mills.

29. The paint brush of claim 21, wherein said synthetic bristles include multiple craters in the outer surface thereof for providing rough and irregular surface regions.

* * * * *